US006572028B1

(12) United States Patent
Fly et al.

(10) Patent No.: US 6,572,028 B1
(45) Date of Patent: Jun. 3, 2003

(54) COMBINED NEEDLE GUIDE, FILTER, AND FLOW DIRECTOR FOR GASOLINE FUEL INJECTORS

(75) Inventors: Ron G. Fly, Saline, MI (US); Thomas Arthur Lahnala, Saline, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/487,440

(22) Filed: Jan. 19, 2000

(51) Int. Cl.[7] ..... F02D 1/00; B05B 1/30; F02M 51/00

(52) U.S. Cl. ..... 239/5; 239/585.1; 239/584; 239/585.3; 239/585.4; 239/585.5; 239/533.12

(58) Field of Search ..... 239/5, 575, 584, 239/585.1, 585.3, 585.4, 585.5, 553, 553.3, 553.5, 533.2, 533.3, 533.9, 533.11, 533.12, 533.14, 590, 590.3, 590.5, 900, DIG. 23; 137/550; 251/129.21

(56) References Cited

U.S. PATENT DOCUMENTS 4,030,668 A 6/1977 Kiwior
4,971,254 A * 11/1990 Daly et al. ..... 239/533.12 X
5,012,983 A 5/1991 Buchholz
5,058,549 A 10/1991 Hashimoto
5,088,650 A 2/1992 Takagi
5,232,163 A 8/1993 Grytz
5,423,489 A 6/1995 Wood
5,678,767 A 10/1997 Rahbar
5,704,553 A * 1/1998 Wieczorek et al. ..... 239/585.1
5,755,386 A * 5/1998 Lavan et al. ..... 239/585.4
5,765,750 A 6/1998 Pace et al.
5,794,856 A 8/1998 Nally
5,860,601 A 1/1999 Egizi
6,003,791 A * 12/1999 Reiter ..... 239/585.5 X
6,015,103 A * 1/2000 Kotkowicz ..... 239/533.12 X
6,065,692 A * 5/2000 Brinn, Jr. ..... 239/533.12 X

* cited by examiner

*Primary Examiner*—Robin O. Evans
(74) *Attorney, Agent, or Firm*—John Kajander

(57) ABSTRACT

A fuel injector (10), including a housing (12), an armature assembly (14), an injector needle (16), a needle seat (18), a needle guide (20), and a orifice disc (22) containing one or more orifice metering pathways (24). The needle guide (20) contains a center guide bore (26) and a plurality of filtering passageways (28). The plurality of filtering passageways (28) are used to filter fuel passing through the needle guide (20) and induce swirl in the fuel to improve atomization.

24 Claims, 4 Drawing Sheets

COMBINED NEEDLE GUIDE, FILTER, AND FLOW DIRECTOR FOR GASOLINE FUEL INJECTORS

TECHNICAL FIELD

The present invention relates generally to a fuel injector and more particularly to improvements in the design of fuel injectors utilizing needle guides.

BACKGROUND ART

Conventional fuel injectors utilize external filters to remove particulates from the fuel as it approaches the fuel injector's inlet. While such filters are suitable for preventing particulate material in the fuel from entering the fuel injector, they are incapable of filtering particulate material that may originate internally within the fuel injector. Particulates may originate within the fuel injector due to manufacturing, assembly or through usage of the fuel injector.

It is known that filters may be located within the fuel injector between the inlet and the internal valve. It is optimal to locate the filter as close to the internal valve as possible so as to catch particulates originating internally in the fuel injector. It is also known that a filter may be located on top of a lower needle guide to filter the fuel at a position just above the internal valve.

The lower needle guide, that can be used to position such a filter, is a known element located above the valve seat. The lower needle guide commonly contains a center guide bore that receives the injector needle passed there through. The center guide bore insures that the injector needle is properly seated on the valve seat when the fuel injector is in the closed position. In one known embodiment, the valve guide contains several large passage bores surrounding the center guide bore to allow fuel to pass through the needle guide to the internal valve. An internal filter is located on top of the needle guide to filter fuel before it passes through the large passage bores in the needle guide. Fluid can only pass through the areas of the internal filter located directly above the large passage bores leaving sections of the filter unused. This design is inefficient since only portions of the filter can be utilized. It would be desirable to have a design with a more efficient filtering system.

In addition to inefficiency, the known embodiment has further disadvantages. The addition of a filtering element can require tight manufacturing tolerances and precise assembly procedures. The filter and the needle guide must be aligned properly to prevent contact between the filter element and the injector needle. Improper assembly, manufacture, or post assembly movement of the filter can cause contact with the injector needle. Contact with the injector needle can cause unwanted friction in the movement of the injector needle. Such undesired friction may result in undesirable wear and possible performance problems of the injector needle. It is therefore desirable to have an internal filter design that eliminates the assembly requirements and alignment problems that can lead to interference with the injector needle.

It is also known that introducing swirl turbulence in the fuel as it passes through the fuel injector is desirable since it improves the atomization of the fuel and thereby improves the fuel injector performance. In several known embodiments, the swirl turbulence is induced through the use of elements located downstream of the valve seat. Placing swirl turbulence elements downstream of the valve seat can require an increase in the volume of space downstream the valve seat. Increasing the volume of space downstream the valve seat can increase hydrocarbon emissions. A major goal of the automotive industry has been to minimize hydrocarbon emissions. It is therefore desirable to induce swirl turbulence without the need to increase the volume of space downstream of the valve seat.

One known method of increasing swirl turbulence without increasing the volume of space downstream of the valve seat is by inducing swirl in the fuel as it passes through the valve guide. In a known design, a tangential flow is induced as the fuel is passed through the valve guide. Such designs have not contemplated the use of non-tangential flow swirl such as micro-swirl to improve fuel atomization. In addition, such designs require a separate filter element and therefore are subject to the efficiency, assembly and alignment problems that are associated with the addition of a separate filter element to the fuel injector. It would therefore be desirable to retain the swirl turbulence characteristics of the known tangential flow swirl design while allowing for non-tangential swirl and adding filtering characteristics that do not cause efficiency, assembly or alignment problems.

SUMMARY OF THE INVENTION

It is therefore an object of the present invention to provide a fuel injector with a needle guide that combines the characteristics of a conventional valve guide and filter element into a single element whereby the efficiency of the filter is increased, the assembly requirements of the fuel injector are minimized, and friction transmitted to the injector needle is reduced. It is a further object of the present invention to provide a valve guide that induces swirl turbulence in the fuel passing through it without increased hydrocarbon emissions or increased manufacturing costs associated with known designs.

In accordance with the objects of this invention, a fuel injector is provided. The fuel injector includes a housing. Located within the housing is an armature assembly which includes an injector needle. The injector needle is movable between a closed position and an open position. The injector needle remains in contact with a valve seat when the injector needle is located in the closed position.

The fuel injector includes an orifice disc located downstream of the valve seat. The orifice disc contains one or more orifice metering pathways to direct fuel passing through the orifice disc towards a desired location.

The fuel injector also includes a needle guide located upstream of the valve seat. The needle guide contains a bore through which the injector needle passes. The bore keeps the injector needle properly positioned on the valve seat to insure a proper seal when the injector needle is located in the closed position. The needle guide also contains a plurality of filtering passageways to allow fuel to pass through the needle guide. Each of the plurality of filtering passageways is of a smaller cross-sectional area than each of the one or more orifice metering pathways located in the orifice disc to prevent particulates larger than the metering pathways from passing through the needle guide. The sum of the areas of the plurality of filtering passageways is greater than the sum of the areas of the one or more orifice metering pathways to insure adequate flow through the fuel injector. The plurality of filtering passageways may be formed at angles relative to the injector needle to force swirl turbulence in the fuel passing through the needle guide.

Other objects and features of the present invention will become apparent when viewed in light of the detailed description of the preferred embodiment when taken in conjunction with the attached drawings and appended claims.

DESCRIPTION OF THE PREFERRED EMBODIMENT(S)

Figure 1:
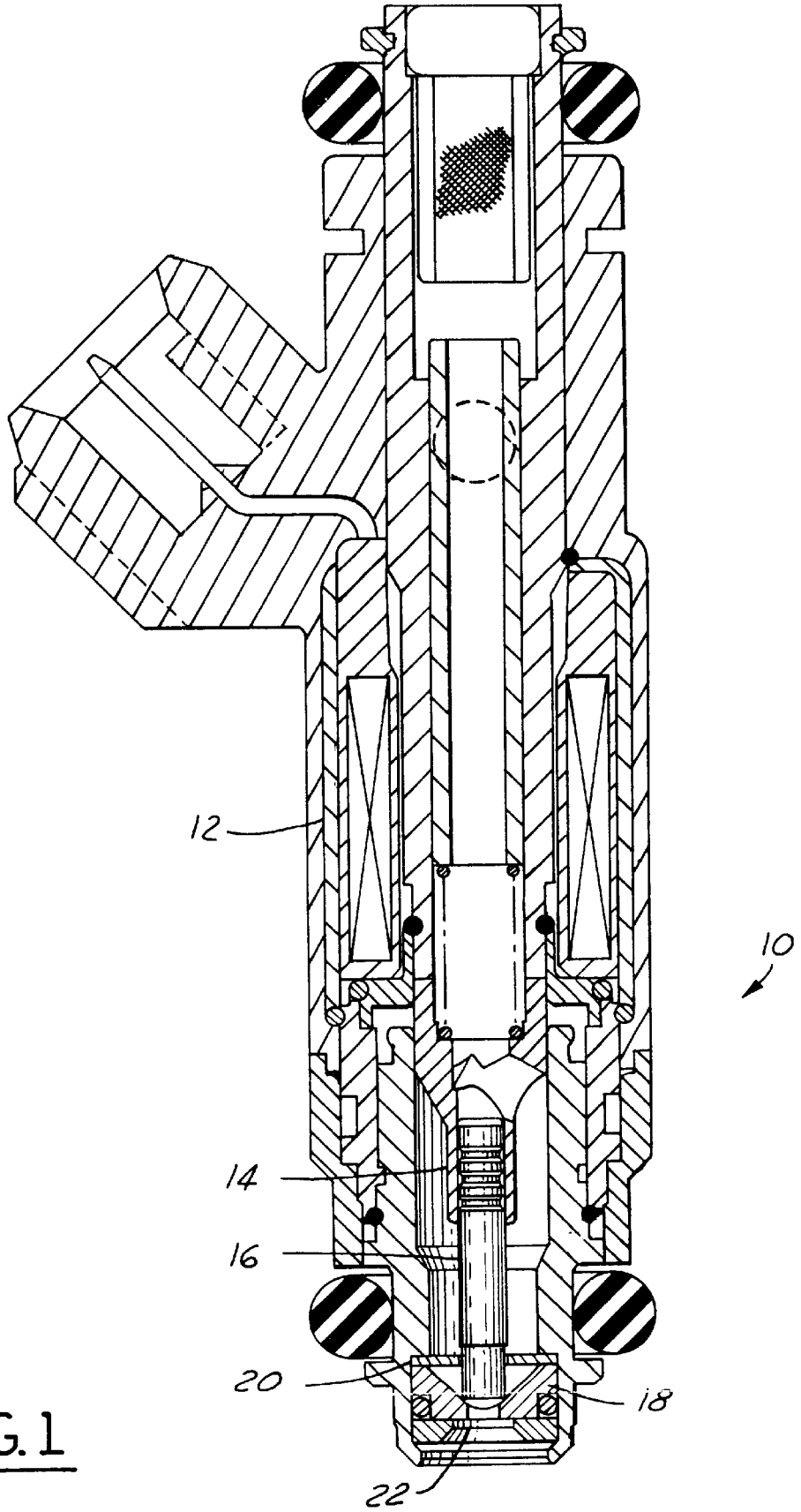
FIG. 1 is a cross-sectional view of a preferred embodiment of a fuel injector in accordance with the present invention.

Referring now to FIG. 1, which is a cross-sectional view of a fuel injector 10 in accordance with the present invention. The disclosed fuel injector 10 is preferably for use with gasoline. However, the disclosed fuel injector 10 may be used with a variety of other fuels such as Methanol, Ethanol, MTBE, Natural Gas, Propane and other gaseous or liquid fuels. The fuel injector 10 is preferably for use in automotive applications, but may be used in a variety of other applications.*

* The applications include, but are not limited to, pesticide, food, paint and solvent spray devices.

The fuel injector 10, comprises a housing 12, an armature assembly 14, an injector needle 16, a needle seat 18, a needle guide 20 and an orifice disc 22. The armature assembly 14 controls the movement of the injector needle 16 between a closed position where it remains in contact with the needle seat 18 and an open position where it allows fuel to flow from the fuel injector 10 past the needle seat 18.

Figure 2:
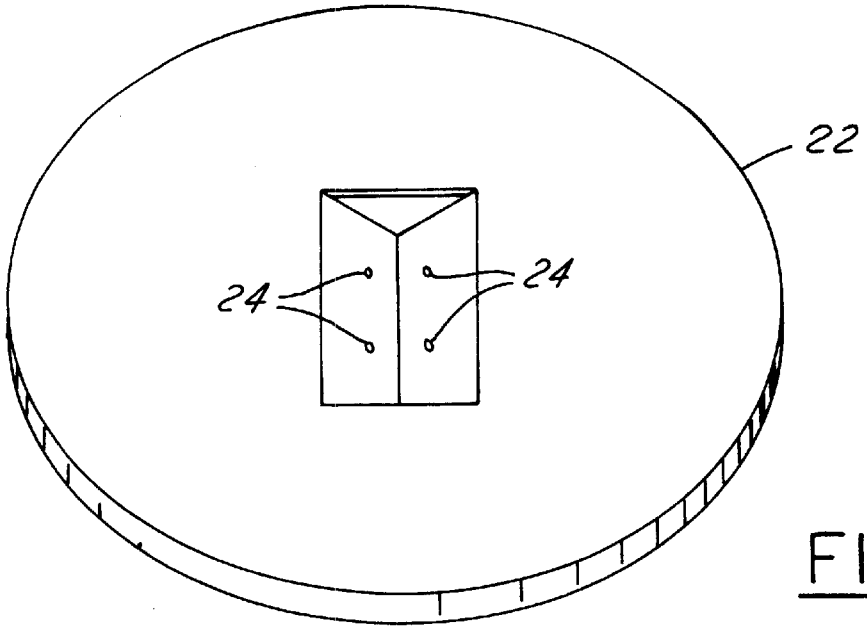
FIG. 2 is a schematic view of the orifice disc illustrated in FIG. 1.

After the fuel passes past the needle seat 18 it flows through the orifice disc 22. Referring now to FIG. 2, the orifice disc 22 contains one or more orifice metering pathways 24 that can be used to direct the fuel in specific directions as it leaves the fuel injector 10. While the orifice disc 22 and the one or more orifice metering pathways 24 are illustrated with respect to a particular embodiment, those skilled in the art will understand that they can be configured in a variety of other embodiments.

Referring now to FIG. 3, which is an embodiment of the needle guide 20 illustrated in FIG. 1. The needle guide 20 contains a center guide bore 26. The injector needle 16 passes through the center guide bore 26. The center guide bore 26 insures that the injector needle 16 remains seated properly on the needle seat 18 when the injector needle 16 is in the closed position. The needle guide 20 is attached to the housing 12 to prevent movement of the needle guide 20 during operation.

The needle guide 20 further contains a plurality of filtering passageways 28. These filtering passageways 28 allow fluid to pass through the needle guide 20. The plurality of filtering passageways 28 are each of a smaller cross-sectional area than each of the one or more orifice metering pathways 24 to prevent particulates larger than the orifice metering pathways 24 from passing through the needle guide 20. In one embodiment, the typical size for each of the plurality of filtering passageways 28 would be approximately 100 microns. It should be understood that a variety of other sizes may be utilized. In addition, the sum of the areas of the plurality of filtering passageways 28 is greater than the sum of the areas of the one or more orifice metering pathways 24 to ensure adequate flow through the fuel injector 10. In one embodiment the sum of the areas of the plurality of filtering passageways 28 is at least 3 times greater than the sum of the areas of the one or more orifice metering pathways 24.

The plurality of filtering passageways 28 and the center guide bore 26 are both part of a single element, the needle guide 20. By combining the filtering component and the needle guide component known in present designs into a single component, the efficiency of the filter is improved and the assembly and alignment problems associated with using separate components are reduced. By filtering the fuel close to the needle seat 18, the needle guide 20 can catch a greater number of particulates originating internally in the fuel injector 10.

Figure 3A:
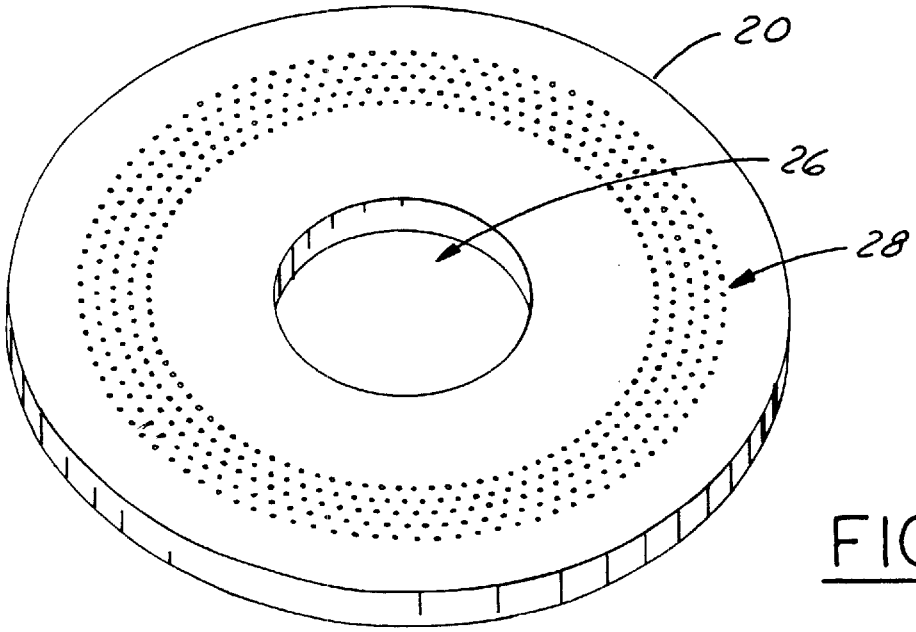
FIG. 3A is a schematic view of an embodiment of the needle guide illustrated in FIG. 1.
Figure 3B:
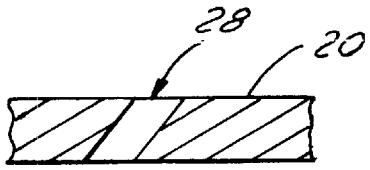
FIG. 3B is a cross-sectional view of the embodiment of the needle guide illustrated in FIG. 3A, the cross-section being taken along the line 3B—3B in FIG. 3A and in the direction of the arrows.

In the embodiment shown in FIG. 3A, the plurality of filtering passageways 28 are formed in the needle guide 20 through the use of a laser tool. One such laser tool is known in the art as a pumped diode laser. The plurality of filtering passageways 28 can be cut using the laser tool at an angle relative to the plane of the needle guide 20 (see FIG. 3B). While one angle is shown, a variety of angles may be utilized. As fuel passes through these angled passageways 28, it is not only filtered, but a swirl motion is imparted to the fuel. This swirling motion creates turbulence and improves the atomization of the fuel. The plurality of filtering passageways 28 do not need to be at a fixed angle relative to the axis of the injector needle 16, nor do they need to be uniform in size or even round. The angles of the plurality of filtering passageways 28 may be formed to induce a tangential swirl around the injector needle 16 or may be formed to induce localized micro-swirl inl the fuel. The needle guide 20 in this embodiment filters the fuel, guides the injector needle 16, and induces swirl in the fuel all from a single element. This reduces the number of parts within the fuel injector 10 and simplifies assembly.

Figure 4:
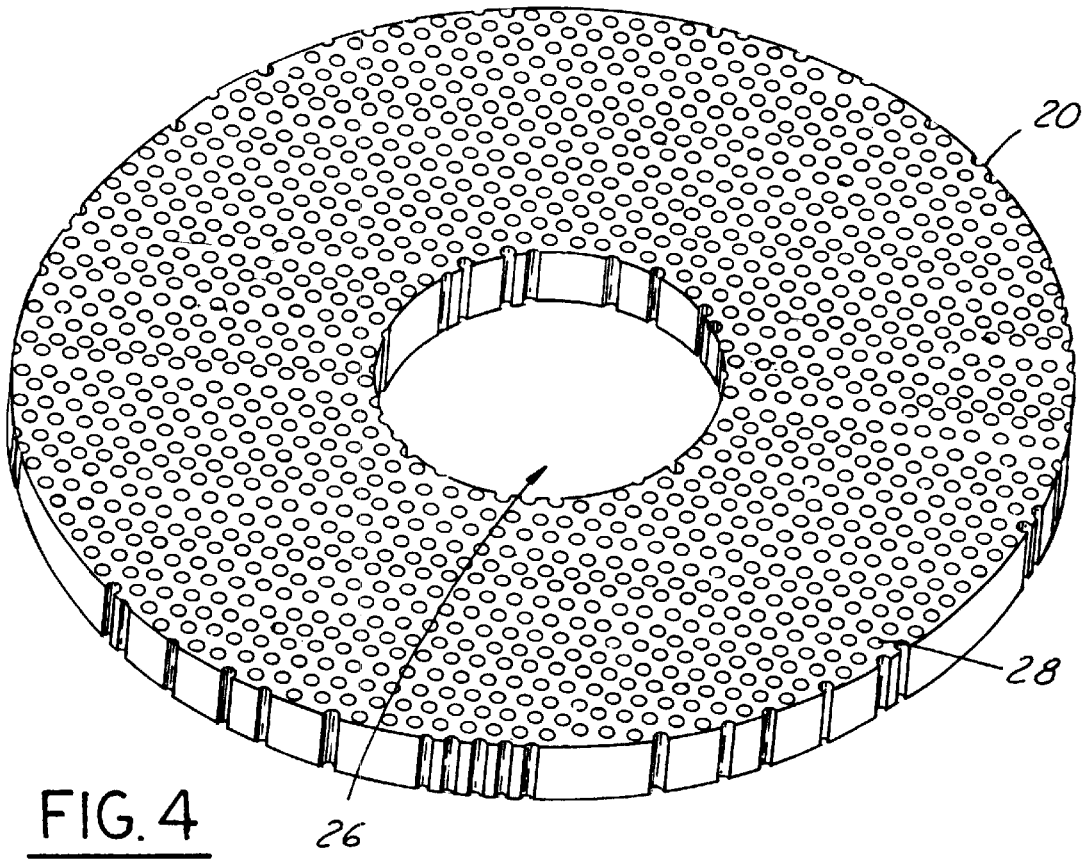
FIG. 4 is a schematic view of an embodiment of the needle guide illustrated in FIG. 1.

In an alternate embodiment shown in FIG. 4 the plurality of filtering passageways 28 are created by forming the needle guide 20 through a stamping of similar process from a material with pre-formed holes. In this embodiment, all the features of the embodiment shown in FIG. 3A are retained, however, manufacturing cost is reduced. Similarly, the plurality of filtering passageways 28 shown in FIG. 4 may be angled to further induce swirl in fuel passing through the needle guide 20. Although the plurality of filtering passageways 28 appear to be uniform in FIG. 4, they need not be uniform in either size, shape or angle.

Figure 5:
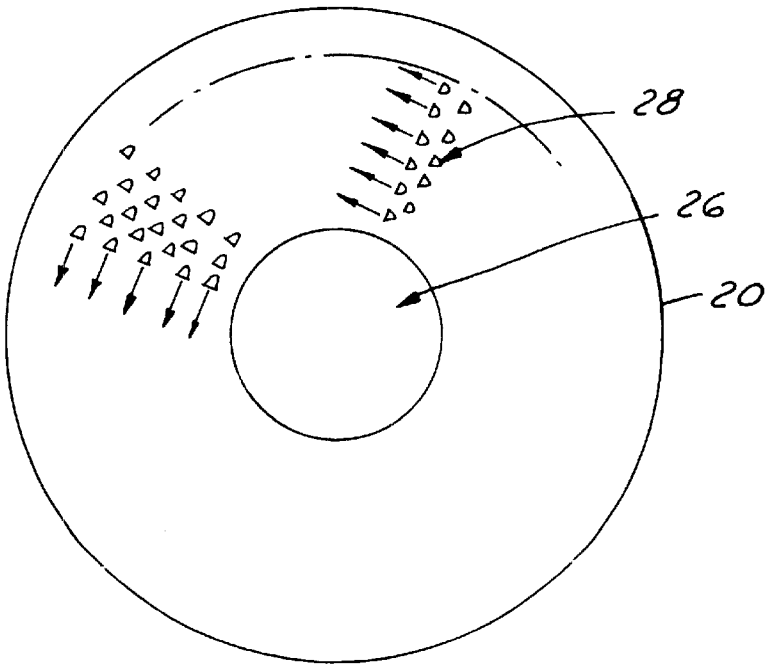
FIG. 5 is a schematic view of an embodiment of the needle guide illustrated in FIG. 1.

An alternate embodiment is shown in FIG. 5. In this embodiment the plurality of filtering passageways 28 are formed in the needle guide 20 through a process that stamps the filtering passageways 28 through the needle guide 20. This embodiment retains all of the characteristics of the embodiment shown in FIG. 3A, however it involves simple and standard machining operations to produce. Although FIG. 5 indicates that the plurality of filtering passageways 28 create a swirl flow tangential to the injector needle 16 radius, the plurality of filtering passageways 28 may be formed to create fuel swirl in a variety of formations.

Figure 6A:
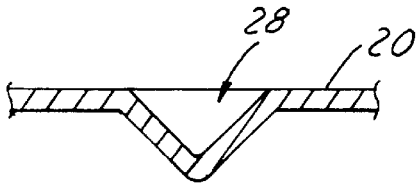
FIG. 6A is a front view of a detail of a stamping shape for use in forming the plurality of filtering passageways illustrated in FIG. 5.
Figure 6B:
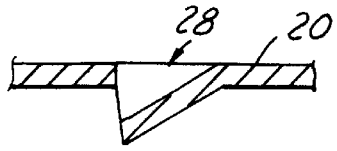
FIG. 6B is a side view of a detail of a stamping shape for use in forming the plurality of filtering passageways illustrated in FIG. 5.
Figure 7A:
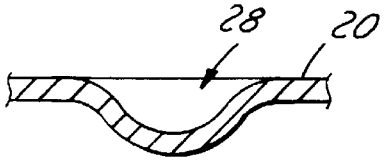
FIG. 7A is a front view of a detail of a stamping shape for use in forming the plurality of filtering passageways illustrated in FIG. 5.
Figure 7B:
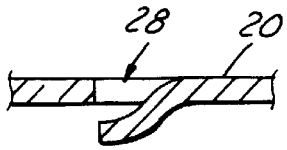
FIG. 7B is a side view of a detail of a stamping shape for use in forming the plurality of filtering passageways illustrated in FIG. 5.
Figure 8A:
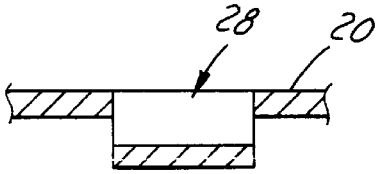
FIG. 8A is a front view of a detail of a stamping shape for use in forming the plurality of filtering passageways illustrated in FIG. 5.
Figure 8B:
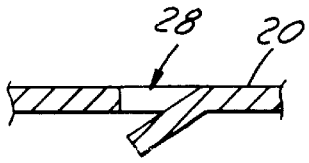
FIG. 8B is a side view of a detail of a stamping shape for use in forming the plurality of filtering passageways illustrated in FIG. 5.

In addition to allowing variation in the direction of the swirl, the plurality of filtering passageways 28 shown in FIG. 5 may also be formed in a variety of shapes. These shapes may be altered to correspond with requirements in machining, filter size, or fluid flow. FIGS. 6A and 6B are illustrations of a shape created with a v-shaped punch tool. FIGS. 7A and 7B are illustrations of a shape created with a curved punch tool. And FIGS. 8A and 8B are illustrations of a shape created with a straight punch tool. With such flexibility in form, the plurality of filtering passageways 28 can be produced without expensive retooling. Although these figures illustrate only three possible configurations, it should be understood that a variety of other configurations using a variety of known manufacturing techniques are possible.

Finally, while several configurations of the needle guide 20 have been described, a variety of designs are available. The plurality of filtering passageways 28 may be formed in the needle guide 20 using any number of known manufacturing techniques. This includes forming the needle guide 20 out of a mesh screen, photo-etching the plurality of filtering passageways onto the needle guide 20 or the use of any other manufacturing technique.

While particular embodiments of the invention have been shown and described, numerous variations and alternate embodiments will occur to those skilled in the art. Accordingly, it is intended that the invention be limited only in terms of the appended claims.

What is claimed is:

1. An fuel injector comprising:

a housing;

a armature assembly including an injector needle that is movable between a closed position and an open position;

a needle seat for receiving said injector needle when in said closed position;

an orifice disk disposed downstream of said needle seat, said orifice disk comprising one or more orifice metering pathways to direct fuel towards a desired location;

a needle guide disposed upstream of said needle seat, said needle guide comprising a plurality of filtering passageways to allow fuel to pass through said needle guide and induce microswirl in the fuel, each of said plurality of filtering passageways and each of said one or more orifice metering passageways having an area, the sum of said areas of said plurality of filtering passageways being greater than the sum of said areas of said one or more orifice metering pathways, and said area of each of said plurality of filtering passageways being smaller than said area of each of said one or more orifice metering pathways to prevent particles larger than said one or more orifice metering pathways from passing through said needle guide; and a bore formed in said needle guide, through which said injector needle passes, wherein said bore keeps said injector needle seated properly on said needle seat when said injector needle is in said closed position.

2. A fuel injector as described in claim 1, wherein said plurality of filtering passageways are formed in said needle guide through the use of a laser.

3. A fuel injector as described in claim 1, wherein said plurality of filtering passageways are created by forming said needle guide out of a sheet of material with pre-formed holes.

4. A fuel injector as described in claim 1, wherein said plurality of filtering passageways are formed in said needle guide through the use of a photo-etching process.

5. A fuel injector as described in claim 1, wherein said plurality of filtering passageways are formed by punching holes in said needle guide.

6. A fuel injector as described in claim 1, wherein said needle guide comprises a mesh and said plurality of filtering passageways are comprised of gaps in said mesh.

7. An fuel injector comprising:

a housing;

a armature assembly including an injector needle movable between a closed position and an open position;

a needle seat for receiving said injector needle in said closed position;

an orifice disk disposed downstream of said needle seat, said orifice disk comprising one or more orifice metering pathways to direct fuel towards a desired location;

a needle guide disposed upstream of said needle seat, said needle guide comprising a plurality of filtering passageways to allow fuel to pass through said needle guide and induce swirl in the fuel, each of said plurality of filtering passageways and each of said one or more orifice metering passageways having an area, the sum of said areas of said plurality of filtering passageways being greater than the sum of said areas of said one or more orifice metering pathways, and said area of each of said plurality of filtering passageways being smaller than said area of each of said one or more orifice metering pathways to prevent particles larger than said one or more orifice metering pathways from passing through said needle guide; and a bore formed in said needle guide through which said injector needle passes, wherein said bore keeps said injector needle seated properly on said needle seat when said injector needle is in said closed position.

8. A fuel injector as described in claim 7, wherein said plurality of filtering passageways are formed in said needle guide through the use of a laser.

9. A fuel injector as described in claim 7, wherein said plurality of filtering passageways are created by forming said needle guide out of a sheet of material with pre-formed holes.

10. A fuel injector as described in claim 7, wherein said plurality of filtering passageways are formed in said needle guide through the use of a photo-etching process.

11. A fuel injector as described in claim 7, wherein said plurality of filtering passageways are formed by punching holes in said needle guide.

12. A fuel injector as described in claim 7, wherein said needle guide comprises a mesh and said plurality of filtering passageways are comprised of gaps in said mesh.

13. A method for filtering fuel passing through a fuel injector comprising a housing, an armature assembly, an injector needle, an orifice disc and a needle guide, comprising the step of:

passing the fuel through the needle guide, the needle guide being comprised of a plurality of filtering passageways, each of said plurality of filtering passageways having an area sized to prevent oversized particulates from passing through the needle guide, and said plurality of filtering passageways formed to induce microswirl in the fuel.

14. A method for filtering fuel as described in claim 13, wherein said plurality of filtering passageways are formed in the needle guide through the use of a laser.

15. A method for filtering fuel as described in claim 13, wherein said plurality of filtering passageways are created by forming the needle guide out of a sheet of material with preformed holes.

16. A method for filtering fuel as described in claim 13, wherein said plurality of filtering passageways are formed in the needle guide through the use of a photo-etching process.

17. A method for filtering fuel as described in claim 13, wherein said plurality of filtering passageways are formed by punching holes in the needle guide.

18. A method for filtering fuel as described in claim 13, wherein said needle guide comprises a mesh and said plurality of filtering passageways are comprised of gaps in said mesh.

19. A method for filtering and inducing swirl to fuel passing through a fuel injector comprising a housing, an armature assembly, an injector needle, an orifice disc and a needle guide, comprising the step of:

passing the fuel through the needle guide, the needle guide being comprised of a plurality of filtering passageways, each of said plurality of filtering passageways having an area sized to prevent oversized particulates from passing through the needle guide, and said plurality of filtering passageways formed to induce swirl in the fuel.

20. A method for filtering fuel as described in claim 19, wherein said plurality of filtering passageways are formed in the needle guide through the use of a laser.

21. A method for filtering fuel as described in claim 19, wherein said plurality of filtering passageways are created by forming the needle guide out of a sheet of material with preformed holes.

22. A method for filtering fuel as described in claim 19, wherein said plurality of filtering passageways are formed in the needle guide through the use of a photo-etching process.

23. A method for filtering fuel as described in claim 19, wherein said plurality of filtering passageways are formed by punching holes in the needle guide.

24. A method for filtering fuel as described in claim 19, wherein said needle guide comprises a mesh and said plurality of filtering passageways are comprised of gaps in said mesh.

* * * * *